US006919096B2

(12) United States Patent
Selk

(10) Patent No.: US 6,919,096 B2
(45) Date of Patent: Jul. 19, 2005

(54) CAKE-SHAPED COOKIE PACKAGE AND DISPLAY

(76) Inventor: Walter Selk, One Treadwell Ave., Madison, NJ (US) 07940

( * ) Notice: Subject to any disclaimer, the term of this patent is extended or adjusted under 35 U.S.C. 154(b) by 100 days.

(21) Appl. No.: 10/386,918

(22) Filed: Mar. 12, 2003

(65) Prior Publication Data

US 2004/0178105 A1 Sep. 16, 2004

(51) Int. Cl.[7] ..... A23G 1/00; B65D 73/00; B65D 85/00

(52) U.S. Cl. ..... 426/104; 206/445; 206/457; 206/459.5; 312/284

(58) Field of Search ..... 206/223, 457, 206/459.5, 459.1, 445; 426/104, 106–132; 312/284; 40/312; D7/553.6, 553.8, 546, 549; 422/104, 106–132

(56) References Cited

U.S. PATENT DOCUMENTS

| | | | | | |
|---|---|---|---|---|---|
| 1,935,831 | A | * | 11/1933 | Cunningham | 431/253 |
| 2,334,497 | A | | 11/1943 | Lemrow | |
| 2,347,041 | A | * | 4/1944 | Filsinger | 312/204 |
| 2,637,617 | A | * | 5/1953 | Stotter | 312/284 |
| 2,659,485 | A | * | 11/1953 | Duley et al. | 206/365 |
| 3,442,378 | A | * | 5/1969 | Wolfe | 206/459.5 |
| 3,843,220 | A | | 10/1974 | Snider | |
| 3,957,327 | A | * | 5/1976 | Parrish | 312/284 |
| D289,220 | S | | 4/1987 | Dowdy et al. | |
| 4,844,243 | A | | 7/1989 | Stiles | |
| 4,947,722 | A | * | 8/1990 | Lewis | 84/95.2 |
| 5,413,801 | A | * | 5/1995 | McIlwain | 426/420 |
| 5,582,478 | A | * | 12/1996 | Ambrosino | 362/234 |
| D403,558 | S | | 1/1999 | Martinez | |
| 6,305,547 | B1 | * | 10/2001 | Curran | 206/542 |
| D479,439 | S | * | 9/2003 | Joss et al. | D7/553.4 |

* cited by examiner

*Primary Examiner*—Bryon P. Gehman
(74) *Attorney, Agent, or Firm*—Lucas & Mercanti, LLP

(57) ABSTRACT

Apparatus for serving bakery products including an upright cake-shaped body having an upper wall and product-receiving slots descending downwardly from the upper wall. The upper wall includes one or more slots descending downwardly therefrom and which are smaller than the product-receiving slots and adapted to receive candles or other party paraphernalia. In use, bakery products such as cookies are placed into the slot and the body with the bakery products can be sealed and sold as such. When being presented as a dessert, candles and/or other party paraphernalia may be inserted into the slots in the upper wall. The bakery products can be easily removed from the product-receiving slots, and the product-receiving slots can even be re-filled with more bakery products.

23 Claims, 3 Drawing Sheets

CAKE-SHAPED COOKIE PACKAGE AND DISPLAY

FIELD OF THE INVENTION

The present invention relates to a non-edible cake-shaped structure capable of receiving and displaying cookies. The present invention also relates to a method for packaging cookies in a non-edible cake-shaped structure to provide a novel cookie distribution method.

BACKGROUND OF THE INVENTION

When celebrating a special occasion, a decorated cake is often purchased and candles and other party paraphernalia are placed onto the cake. Such party paraphernalia may include small plastic novelties and signs, e.g., Happy Birthday, Happy Anniversary.

One drawback of having a party cake is all too often, children receive a piece of cake and do not finish the entire cake as the piece is mis-proportioned. Also, if the size of the cake is not suited to the number of people eating the cake, then a portion of the cake will likely be leftover. Storing a remainder of a cake is cumbersome as it must be wrapped and refrigerated to preserve it for subsequent consumption.

Another drawback of a cake is that it is often uniform, i.e., has the same composition throughout. Thus, if the cake is a chocolate cake and a person does not like chocolate cake, then they will not partake of the dessert.

Thus, it would be ideal if an alternative dessert could be provided which allows for each children and adult to have a more accurate portion, to avoid the need to handle cake leftovers and which enables different types of desserts.

As discussed below, all of these advantages can be realized by using cookies as the dessert because cookies are small so that a child or adult can take as many or as few as they want. Also, any remaining cookies are easily stored and maintain their freshness to a much greater degree than a leftover portion of cake. In addition, cookies come in a variety of different flavors, e.g. chocolate chip cookies, oatmeal cookies, so that different varieties of cookies might be simultaneously presented as dessert so that each person can take whatever flavor they prefer.

A problem arises in that there is no convenient way to package and sell cookies in a form in which they can be displayed and served as dessert.

Furthermore, the cookie market is fairly mature and stable for the foreseeable future. Increasing or maintaining market share for cookies has almost exclusively resided with advertising and marketing. The typical packaging of cookies has either been in tray, sleeve, bag or tin form. The tray and sleeve format are generally used as they are highly efficient, while the bag and tin form are designed to impart a feeling of tradition and quality to the consumer. In recent years, wholesalers have started baking and selling their own cookies and packaging them in what typically amounts to a plastic tin thereby allowing a purchaser to see the cookie being purchased.

Other recent developments appear to be the marketing and selling of cookie bars. In this case, the form of the product is being changed to better compete with the granola and candy bar market which has been and continues to be an alternative snack food to the traditional cookie.

Attempts are not known to have been made to alter the packaging or displaying of cookies to compete with another bakery product such as a cake.

With respect to prior art relating to displaying bakery products, U.S. Pat. No. 5,413,801 (McIlwain) describes an apparatus for serving cupcakes in the form of a cake. A series of support members 12, 14, 18 are arranged on top of one another to define three circular tiers 16, 20 and 22, respectively, with the tiers decreasing in size in the vertical direction. The support members 12, 14 and 18 are connected by a skewer 28 with a candle 30 being placed on the upper end of the skewer 28. The cupcakes 32 are placed in each tier so that when the tiers are full of cupcakes, the resulting product appears like a cake (see FIG. 1).

U.S. Pat. No. 3,843,220 (Snider) describes a multi-layer cake made of a series of containers 11–14 each having a hollow interior in which wrapped cake pieces 16 are placed. By raising each container 11–14, the cake pieces therein are exposed and ready to be served.

U.S. Pat. No. 4,844,243 (Stiles) describes a holder for baked goods such as cupcakes. The holder is in the form of a portion of a hemisphere and has cavities 12 each receivable of a cupcake.

U.S. Pat. Nos. 2,334,497, Des. 289,220 and Des. 403,558 generally describe a cake having party favors thereon and cookie bouquets.

These patents do not disclose a cake-shaped mold capable of receiving and displaying cookies and a method for packaging cookies in a cake-shaped mold.

OBJECTS AND SUMMARY OF THE INVENTION

It is an object of the present invention to provide a cake-shaped structure capable of receiving and displaying cookies.

It is another object of the present invention to provide a method for packaging cookies in a cake-shaped structure to provide a novel cookie distribution method.

It is yet another object of the present invention to provide a bakery dessert which allows for each children or adult to have a more accurate portion and thereby avoid the need to handle dessert leftovers.

It is still another object of the present invention to provide a reusable cake-shaped structure capable of being filled with cookies and which is designed to allow the placement of candles, party favors and other party paraphernalia on the mold.

It is yet another object of the present invention to provide an innovative concept for packaging and marketing cookies in a cake format so that the cookies could supplement a traditional cake or might even substitute for a cake.

It is yet another object of the present invention to provide a cake-shaped structure which is capable of displaying a variety of different bakery products such as cookies to enable different types of bakery products to be simultaneously served.

In order to achieve these objects and others, an apparatus for serving bakery products in accordance with the invention includes an upright body having an upper wall and a plurality of product-receiving slots descending downwardly from the upper wall. The upper wall includes one or more slots descending downwardly therefrom and which are smaller than the product-receiving slots and adapted to receive candles or other party paraphernalia. In use, bakery products such as cookies are placed into the slot and the body with the bakery products can be sealed and sold as such. When being presented as a dessert, candles and/or other party paraphernalia are inserted into the slots in the upper wall. The bakery products can be easily removed from the product-receiving slots, and the product-receiving slots can even be re-filled with more bakery products. As such, cookies can be used as a dessert instead of a cake in a convenient and decorative manner.

The body can take numerous forms, such as cylindrical or rectangular. The product-receiving slots may be circular, since most cookies are generally circular, and arranged along an outer periphery of the body. An opening is formed in the body along each product-receiving slot to enable easy dispensing of the cookies. It is further contemplated that the device will also a include a detachable cover or other means for maintaining the freshness of the cookies displayed therein.

To enhance the device, a sound receiver/generator may be arranged in an interior of the body below a sound transmitting portion. A processor is then arranged in the interior of the body and coupled to the sound receiver/generator and includes a memory unit capable of recording a voice message detected by the sound receiver/generator. A first button on the body is coupled to the processor to cause the processor to record a voice message detected by the sound receiver/generator when depressed while a second button on the body is coupled to the processor to cause the processor to direct the sound receiver/generator to generate the recorded voice message when depressed.

Using the body described above, a kit for displaying and serving bakery products can be provided in accordance with the invention. Such a kit would include the body described above, in any of its forms, and in addition to or instead of the candle-receiving slots, may include an elongated slot. The kit would include one or more greeting signs arranged to be positioned in the elongate slot, each containing a greeting such as Happy Birthday, Happy Anniversary. The kit could also include candles.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
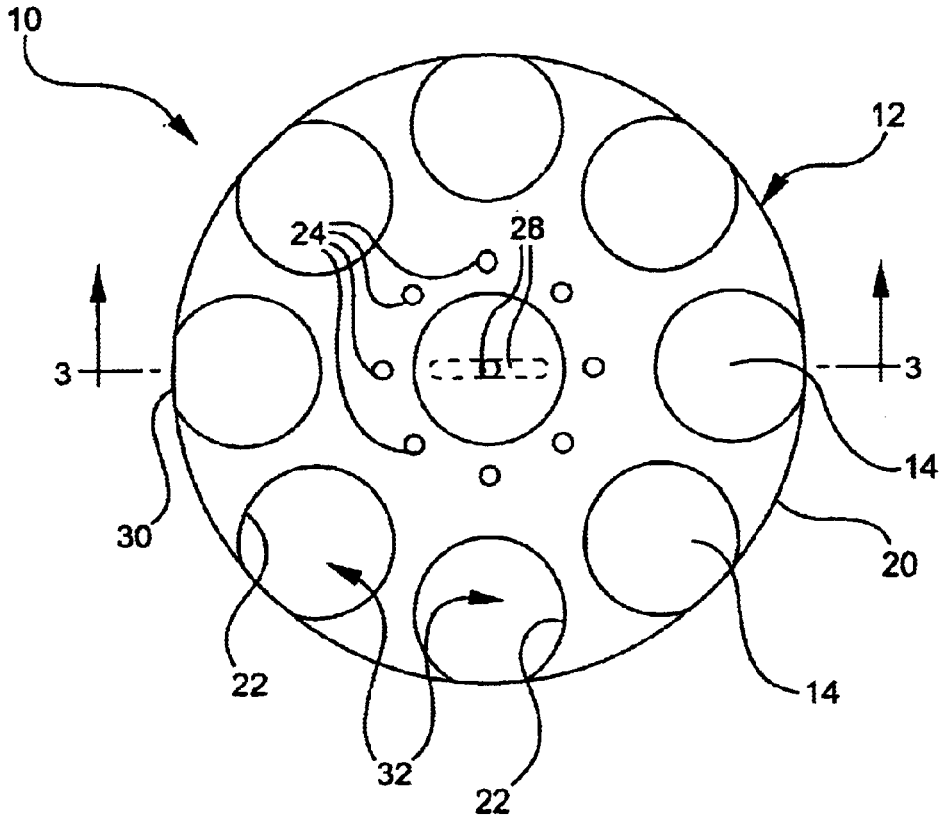
FIG. 1 is a top view of a cake-shaped structure in accordance with the invention.

Referring now to the accompanying drawings wherein the same reference numerals refer to the same or similar elements, FIG. 1 shows a first embodiment of a cake-shaped structure in accordance with the invention which is designated generally as 10. The cake-shaped structure 10 has a generally cylindrical body 12 having a plurality of bakery product-receiving slots 14 (also referred to herein as cookie-receiving slots) distributed around the periphery of the body 12. Preferably, each cookie-receiving slot 14 is substantially cylindrical and thus designed to receive a stack of circular cookies 16 (see FIG. 4). Other shapes are contemplated, however, to suit the needs of the user, cookie type, etc. Furthermore, the exterior portions of the body, i.e. the top and sides may be contoured and/or colored to appear as if a cake having a frosting of chocolate, vanilla, etc.

As shown, the body 12 includes eight cookie-receiving slots 14 evenly distributed around the periphery of the body 12. However, the shape, number and position of the cookie-receiving slots 14 in the body 12 can be varied as desired. Although the receptacles in the body 12 are referred to as slots, they may also be considered as pockets to the extent that pockets are interpreted in a different manner than slots.

The body 12 includes an upper wall 18 and a side wall 20. Upper wall 18 has circular openings 22 forming the upper region of the cookie-receiving slots 14 and a plurality of smaller circular slots or openings 24 distributed in an interior region. Openings 24 serve as candle holders and thus are dimensioned to receive a standard size candles 26 used for cakes (see FIG. 4). Upper wall 18 also includes an elongate slot 28 in its center which is sized to receive a celebratory sign or greeting 31 such as Happy Birthday and the like (see FIG. 4). Additional indicia may be arranged on the upper wall 18 such as a company logo.

Side wall 20 includes openings 30 each leading to a respective one of the cookie-receiving slots 14 to enable the cookies in the cookie-receiving slots 14 to be easily obtained.

Figure 3:
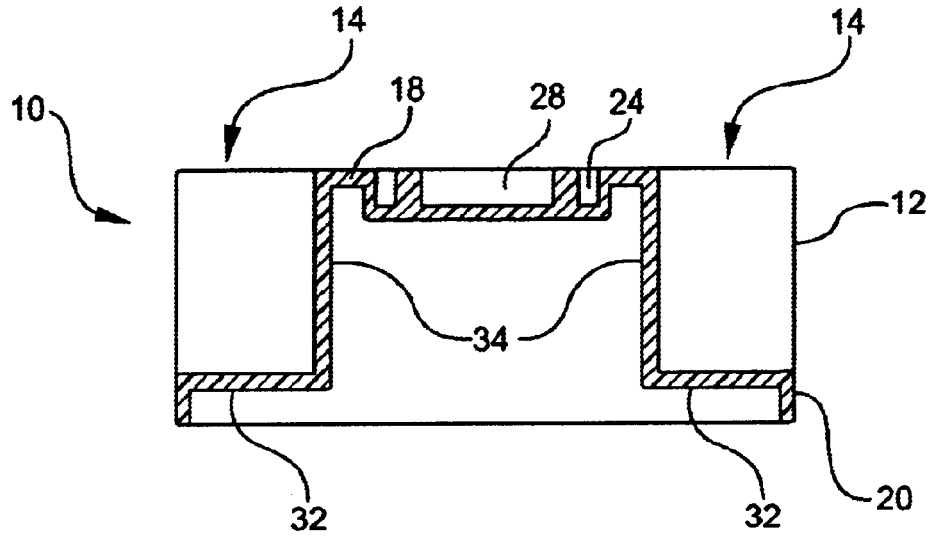
FIG. 3 is a cross-sectional view taken along the line 3—3 in FIG. 1.
Figure 4:
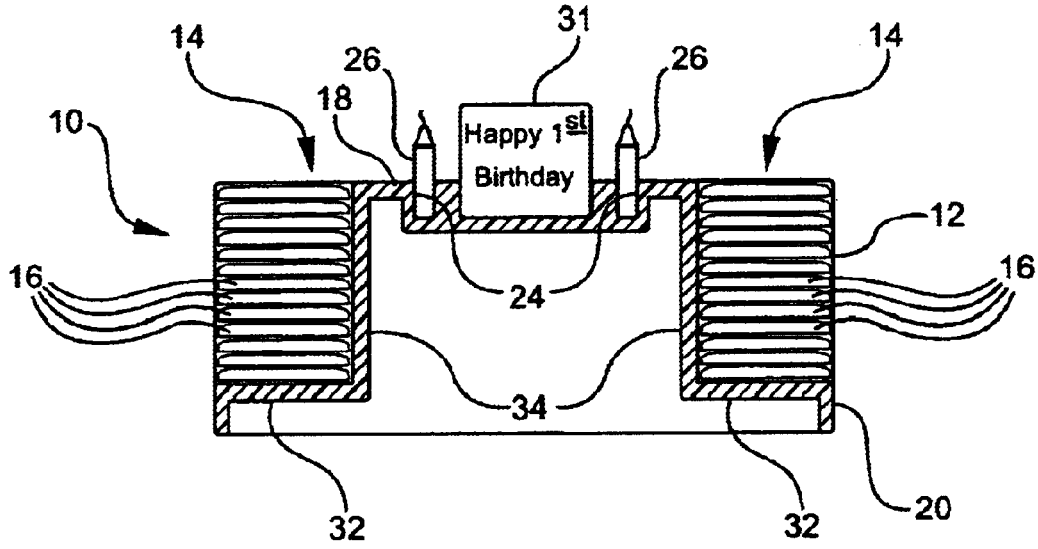
FIG. 4 is a cross-sectional view taken along the line 3—3 in FIG. 1 in a situation in which cookies, candles and a celebratory sign are placed in holes formed in the top of the cake-shaped structure.

To define the cookie-receiving slots 14, the body 12 includes a plurality of planar, bottom walls 32 and arcuate, inner side walls 34 (see FIGS. 3 and 4). The arcuate, inner side walls 34 extend around the cookie-receiving slots 14 except for the openings 30 in the side wall 20.

The presence of the openings 30 in the side wall 20 results in the formation of a small lip portion 36 of the side wall 20 below each opening 30 (see FIG. 2). Nevertheless, it is possible for the openings 30 to extend completely to the bottom of the body 12 in which case, the planar, bottom walls 32 would be contiguous with a lower edge of the side wall 20 of the body 12 and thus contact a support surface on which the cake-shaped structure 10 is placed. This would increase the space for each cookie-receiving slot 14 to a maximum since the cookie-receiving slots 14 would extend substantially the entire height of the body 12.

The dimensions of the body 12 are such to enable normal-sized cookies to be placed into the cookie-receiving slots 14. Thus, each cookie-receiving slot 14 has a diameter of about 1⅞ inches and each candle-receiving opening 24 has a diameter of about ¼ inch. In the embodiment shown, the diameter of the body 12 is about 8¼ inches. All of these dimensions can be varied to create numerous different sized and shaped cake-shaped structures in accordance with the invention.

Figure 2:
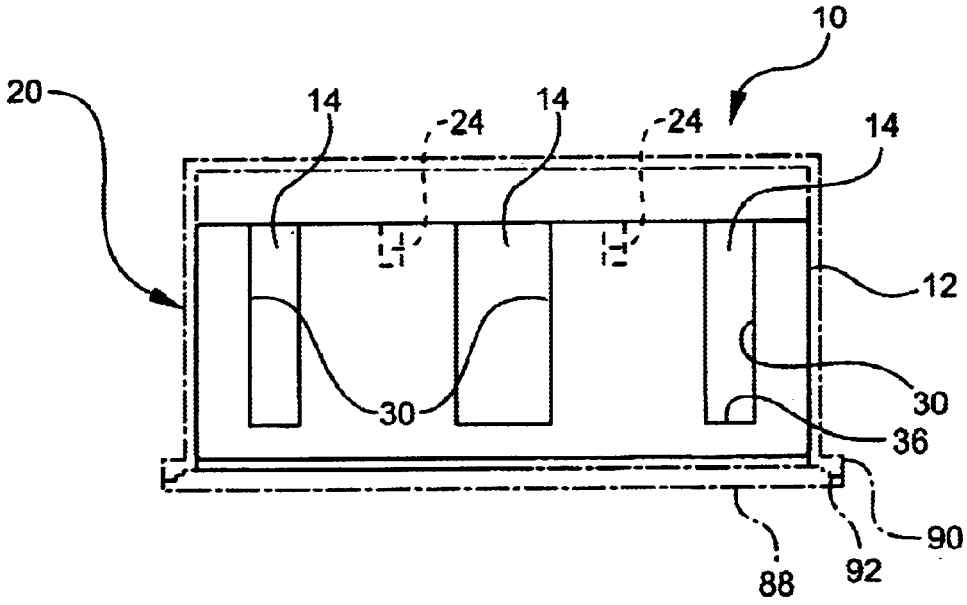
FIG. 2 is a side view of the structure shown in FIG. 1.

As shown in FIG. 2, the device may also be designed to include a base portion 88 designed for receiving a detachable cover 90 operating with a cooperating locking means 92 or other suitable means such as a uniformly designed depressed region running the circumference of the base which releaseably accepts the cover. In operation, the cover attaches to the base in a sealing fashion similar to that well known in the art of resealable plastic food containers. In alternative aspects, the device can be covered with a polyethlyene film or other materials designed for maintaining the cookies included therein or placed therein by a cookie manufacturer or end-user.

Figure 5:
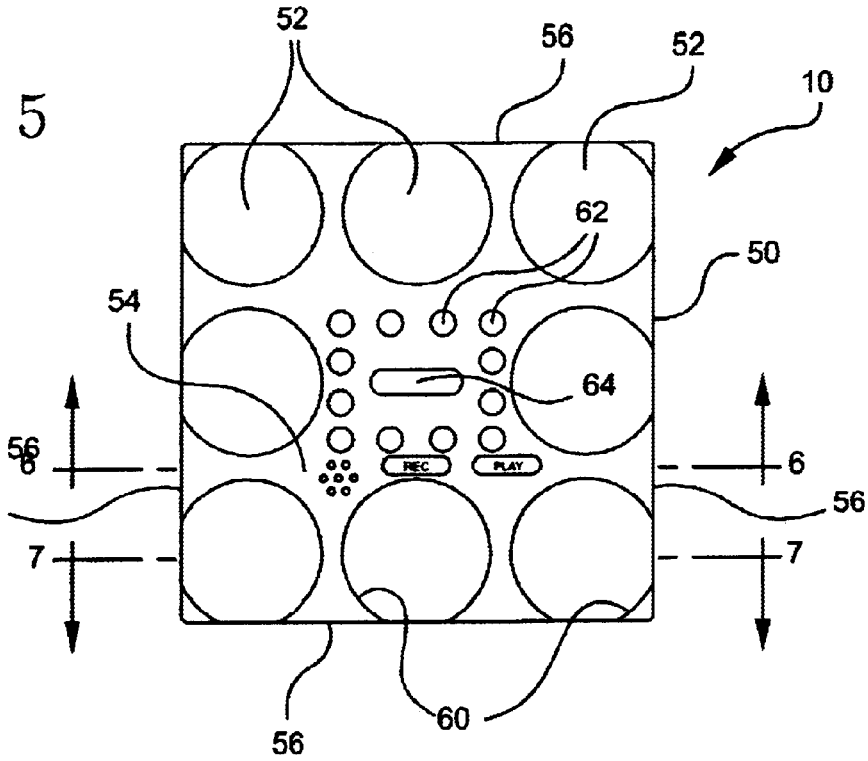
FIG. 5 is a top view of another embodiment of a cake-shaped structure in accordance with the invention.
Figure 6:
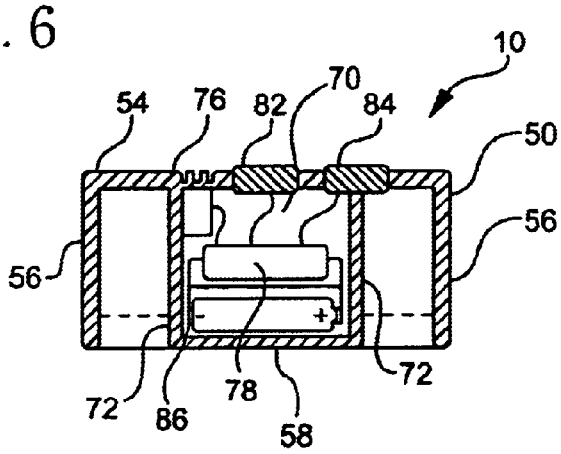
FIG. 6 is a cross-sectional view taken along the line 6—6 in FIG. 5.
Figure 7:
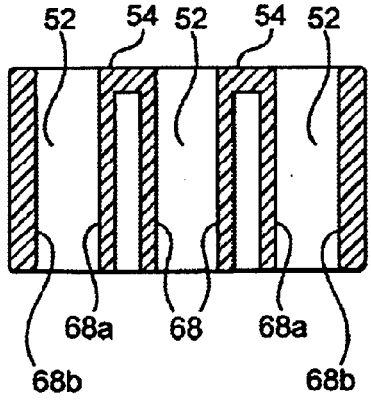
FIG. 7 is a cross-sectional view taken along the line 7—7 in FIG. 5.

Referring now to FIGS. 5 and 6, a second embodiment of a cake-shaped structure 10 in accordance with the invention is shown. In this embodiment, the cake-shaped structure has a body 50 has a generally rectangular form, e.g., a square, and includes nine cookie-receiving slots 52 distributed around the periphery of the body 50. Each cookie-receiving slot 52 is cylindrical and thus designed to receive a stack of substantially circular cookies. The shape, number and position of the cookie-receiving slots 52 in the body 50 can be varied as desired.

The body 50 includes an upper wall 54, a plurality of side walls 56 and a bottom wall 58. Upper wall 54 has circular openings 60 forming the upper region of the cookie-receiving slots 52 and a plurality of smaller circular slots or openings 62 distributed in an interior region. Openings 62 serve as candle holders and thus are dimensioned to receive a standard size candles used for cakes. Upper wall 54 also includes an elongate slot 64 in its center which is sized to receive a celebratory sign or greeting. Additional indicia may be arranged on the upper wall 54. Side walls 56 each include openings each leading to a respective cookie-receiving slot 52 to enable the cookies in the cookie-receiving slots 52 to be easily obtained. As is apparent from FIG. 5, the cookie-receiving slots 52 in the corners are accessed through an opening in each of the adjacent side walls 56.

To define each cookie-receiving slot 52, the body 50 includes a planar, bottom wall 66 and one or more arcuate, inner side walls 68. For the cookie-receiving slots 52 in the middle of each side wall 56, there is a single arcuate inner side wall 68 which is substantially cylindrical (except for an opening in one of the side walls 56) and for the cookie-receiving slots 52 in the corners, there is a first inner arcuate side wall 68*a* and a second outer arcuate side wall 68*b* separated by two openings formed in the adjacent side walls 56.

In this embodiment, an electronics package is provided to enhance the device. Specifically, in the interior of the body 50, compartment 70 is formed by the bottom wall 58 and interior walls 72. In the compartment 70, a sound receiver/generator 74 is mounted below a sound transmitting portion 76 formed in the upper wall 54. A processor or controller 78 is electrically coupled to the sound receiver/generator 74 and includes a memory unit capable of recording a voice message detected by the sound receiver/generator 74. To operate the processor 78 to provide for a specific recorded greeting, a depressible, record button 82 is mounted on the upper wall 54 and coupled to the processor 78 to cause the processor 78 to record a voice message detected by the sound receiver/generator 74 when the button 82 is depressed. Another depressible, play button 84 is also coupled to the processor 78 to cause the processor 78 to direct the sound receiver/generator 74 to generate the recorded voice message when the button 84 is depressed. A battery compartment 86 is also formed in a portion of the compartment 70 for storing one or more batteries 80. An electrical interconnection system, such as wires, is provided for connecting the processor 78 and optionally the sound receiver/generator 74 to the batteries 80.

Using the electronics package described above, it is possible to record a particular greeting, such as "Happy 50$^{th}$ Birthday Jonathon" or "Happy 10th Anniversary Jane and John", and then have the recorded greeting played back when the cookie-filled body 50 is presented to the honorees.

In the alternative, a simpler electronics package could be used which has a limited number of pre-recorded greetings and a mechanism provided to enable selection of a particular one of the pre-recorded greetings. Still further embodiments include the placement of lights or LCD illumination, messages and the like on a surface of the body 12.

The construction of the electronics packages described herein would be known to one skilled in the electronics art and particular details thereof are not believed to be necessary to enable the practice of the embodiments of the invention using the electronics package.

The body including cookie-receiving slots may have any shape including, but not limited to, round, rectangular, square, octagonal, etc. Whatever the shape, the body should be constructed to hold and display the cookies in slots in a manner that resembles a cake.

The body can be a molded, unitary construction, preferably made from plastic. The design and materials of construction of the mold can be from numerous different materials and manufactured using a variety of different manufacturing techniques. Generally, a polymer with a traditional fabrication process using vacuum forming techniques, injection molding, etc. can be employed. The structure can be designed for a one-time use or allow for limited or virtually indefinite use, depending on the process selected. One possible manufacturing method would be to thermoform the mold with pockets drawn to allow for the cookies and the candles and/or celebratory paraphernalia. Thermoforming is a process known to those skilled it the mold-producing art. A non-limiting list of suitable plastics include well known acrylics, polypropylene, polyethylene (PE) or polyvinylchloride (PVC)-based materials, PETG, ABS, etc. Non-plastic materials such as glass, paper laminates or metals, etc can also be used.

A particular advantage obtained using a body or mold with cookie-receiving slots in accordance with the invention is from a marketing standpoint in that the mold increases the flexibility of the marketing aspects. For example, the use of the mold in celebration of a holiday such as Halloween would perhaps have the mold itself be formed with an orange color and a plastic sign could be included with the orange mold, adapted for placement in the elongate slot in the upper wall of the mold, reading "Happy Halloween". This approach could be used for many major holidays, in effect supplementing traditional cookie sales by opening up a new market via the positioning of cookies as cakes or in this case a holiday cake.

In this manner, different kits could be produced, each kit for a particular holiday or occasion. A kit would comprise a mold, in a particular shape and color and/or with a particular number and position of cookie-receiving slots, and a particular greeting for placement in the elongate slot formed in the upper wall of the mold, and, optionally a re-sealable cover for maintaining the freshness of the cookies included therein. Multiple greetings could also be included in a kit to enable the mold's use for different occasions. The kit could also includes candles.

Moreover, a completed cookie package could also be marketed and would comprise a body or mold as described herein, cookies filling the cookie-receiving slots and one or more greetings and optional candles. A sealing or wrapper would be provided over the entire package.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A device for packing, displaying and serving cookies, comprising:

an upright body having an upper wall and a side wall, said upper wall including a plurality of cylindrical first slots open at the top and descending downwardly from said upper wall, said first slots each being adapted to receive a stack of cookies, at least one said first slot containing at least one cookie said upper wall further including a plurality of cylindrical second slots descending downwardly from said upper wall, said second slots being smaller than said first slots and adapted to receive candles, at least one said second slot containing a candle; and said side wall including a plurality of openings, each said opening leading to a respective one of said first slots, so as to enable contained cookies to be easily obtained.

2. The device of claim 1, wherein said body has a generally cylindrical form.

3. The device of claim 1, wherein said body has a generally rectangular form.

4. The device of claim 1, wherein said first slots are arranged around along an outer periphery of said body.

5. The device of claim 1, wherein said second slots are arranged in an interior portion of said upper wall at a distance from an outer periphery of said body.

6. The device of claim 1, wherein said upper wall further includes an elongate slot adapted to receive a celebratory sign.

7. The device of claim 1, wherein said upper wall includes a sound-transmitting portion, further comprising:

a sound receiver/generator arranged in an interior of said body below said at least one sound transmitting portion;

a processor arranged in said interior of said body coupled to said sound receiver/generator and including a memory unit capable of recording a voice message detected by said sound receiver/generator;

a first button coupled to said processor arranged to cause said processor to record a voice message detected by said sound receiver/generator when depressed;

and a second button coupled to said processor arranged to cause said processor to direct said sound receiver/generator to generate the recorded voice message when depressed.

8. The device of claim 7, wherein said body further includes a battery compartment for storing at least one battery and an electrical interconnection system for connecting said processor to the at least one battery when stored in said battery compartment.

9. A device for marketing cookies, comprising:

an upright body having an upper wall and a side wall, said upper wall including a plurality of cylindrical first slots open at the top and descending downwardly from said upper wall, and cookies arranged in a stack in each of said first slots, and said side wall including a plurality of openings, each said opening leading to a respective one of said first slots, so as to enable said cookies to be easily obtained.

10. The device of claim 9, wherein said upper wall further includes a plurality of cylindrical second slots descending downwardly from said upper wall, said second slots being smaller than said first slots and adapted to receive candles.

11. The device of claim 9, wherein said first slots are arranged around along an outer periphery of said body.

12. The device of claim 9, wherein said second slots are arranged in an interior portion of said upper wall at a distance from an outer periphery of said body.

13. The device of claim 9, wherein said upper wall further includes an elongate slot adapted to receive a party favor.

14. The device of claim 9, wherein said upper wall includes a sound-transmitting portion, further comprising:

a sound receiver/generator arranged in an interior of said body below said at least one sound transmitting portion;

a processor arranged in said interior of said body coupled to said sound receiver/generator and including a memory unit capable of recording a voice message detected by said sound receiver/generator;

a first button coupled to said processor arranged to cause said processor to record a voice message detected by said sound receiver/generator when depressed;

and a second button coupled to said processor arranged to cause said processor to direct said sound receiver/generator to generate the recorded voice message when depressed.

15. The device of claim 14, wherein said body further includes a battery compartment for storing at least one battery and an electrical interconnection system for connecting said processor to the at least one battery when stored in said battery compartment.

16. The device of claim 9, further comprising a detachable cover for covering the upright body of said device and a base portion on the bottom of the upright body for receiving said detachable cover, said base and said cover having cooperating releasable locking means for forming a seal therebetween.

17. A kit for displaying and serving cookies, comprising:

an upright body having an upper wall and a side wall, said upper wall including a plurality of cylindrical first slots open at the top and descending downwardly from said upper wall, said first slots each being adapted to receive a stack of cookies, at least one said first slot containing at least one cookie said upper wall including an elongate slot; and at least one greeting sign arranged to be positioned in said elongate slot in said upper wall of said body, said sign containing a greeting message, and said side wall including a plurality of openings, each said opening leading to a respective one of said first slots, so as to enable contained cookies to be easily obtained.

18. The kit of claim 17, wherein said at least one greeting sign comprises a plurality of different greeting signs.

19. The kit of claim 17, wherein said upper wall further includes a plurality of cylindrical second slots descending downwardly from said upper wall, said second slots being smaller than said first slots and adapted to receive candles.

20. The kit of claim 17, wherein said first slots are arranged around along an outer periphery of said body.

21. The kit of claim 17, wherein said second slots are arranged in an interior portion of said upper wall at a distance from an outer periphery of said body.

22. The kit of claim 17, wherein said upper wall includes a sound-transmitting portion, further comprising:

a sound receiver/generator arranged in an interior of said body below said at least one sound transmitting portion;

a processor arranged in said interior of said body coupled to said sound receiver/generator and including a memory unit capable of recording a voice message detected by said sound receiver/generator;

a first button coupled to said processor arranged to cause said processor to record a voice message detected by said sound receiver/generator when depressed;

and a second button coupled to said processor arranged to cause said processor to direct said sound receiver/generator to generate the recorded voice message when depressed.

23. The kit of claim 22, wherein said body further includes a battery compartment for storing at least one battery and an electrical interconnection system for connecting said processor to the at least one battery when stored in said battery compartment.

* * * * *